United States Patent [19]

Cooper

[11] 4,103,598

[45] Aug. 1, 1978

[54] WALL STRUCTURE

[75] Inventor: Kenneth R. Cooper, Don Mills, Canada

[73] Assignee: Canada Square Management Ltd., Toronto, Canada

[21] Appl. No.: 762,075

[22] Filed: Jan. 24, 1977

[30] Foreign Application Priority Data

Jan. 30, 1976 [CA] Canada ..... 244844

[51] Int. Cl.[2] ..... F24F 7/00; F24D 5/10

[52] U.S. Cl. ..... 98/31; 98/33 A; 165/53; 52/303; 237/50

[58] Field of Search ..... 98/31, 32, 33 R, 33 A, 98/95, 96; 237/1 A, 46, 50, 1 R; 165/53; 52/303, 220, 221

[56] References Cited

U.S. PATENT DOCUMENTS

| | | | |
|---|---|---|---|
| 2,928,330 | 3/1960 | Brandi | 98/33 A |
| 2,988,980 | 6/1961 | Tschudin | 98/31 |
| 3,247,895 | 4/1966 | Phillips, Jr. | 98/31 |
| 3,688,983 | 9/1972 | Erickson et al. | 237/50 |
| 3,789,747 | 2/1974 | Wasserman et al. | 52/303 |
| 3,905,548 | 9/1975 | Brodie | 98/31 |
| 3,981,445 | 9/1976 | Custer | 98/31 |

*Primary Examiner*—John J. Camby
*Assistant Examiner*—Henry C. Yuen
*Attorney, Agent, or Firm*—Rogers, Bereskin & Parr

[57] ABSTRACT

A wall structure is described and incorporates an air outlet unit for a forced air circulation system. The structure includes vertical posts which define at least two adjacent wall sections. The air outlet unit is built into one of the wall sections and communicates with one or more adjacent sections by way of openings in the posts. In a preferred embodiment each wall section includes a window panel having a sill member. The sill members are formed with openings at the inner sides of the window panels. Air delivered to the outlet unit issues upwardly through the openings in the sill members.

3 Claims, 3 Drawing Figures

WALL STRUCTURE

This invention relates to a wall structure which includes an outlet for a forced air circulation system.

In buildings having such systems (e.g. air conditioning systems) air outlets are typically provided adjacent peripheral walls of the building. In a multi-storey building each storey may have an individual fan unit for supplying air to the outlets of that storey. The fan units are normally supplied with conditioned (heated or cooled) fresh air and also serve to recirculate air within the occupied space of the storey.

An object of the present invention is to provide an improved wall structure which incorporates an outlet for a forced air circulation system.

According to the invention the structure includes a plurality of spaced vertical posts defining at least two adjacent wall sections. Each section includes a transverse member extending between the posts defining the section, and inner and outer wall panels which cooperate with the member to define an air space between the posts. The transverse member is formed with at least one opening through which air can flow from the said air space. The air outlet unit is disposed in the air space of one of said at least two adjacent sections. The unit defines a chamber which has air inlet means coupled to an air supply duct of the air circulation system. A first air outlet means of said chamber communicates with the said opening of the transverse member defining the air space. The chamber also defines at least one additional air outlet means for delivering air to the air space of said adjacent wall section. The intervening wall post is formed with an opening which permits communication between the last mentioned air space and the additional air outlet means. Accordingly, air delivered to the outlet unit in use can issue through the outlet openings in the transverse members of both adjacent wall sections.

The invention will be better understood by reference to the accompanying drawings which illustrate two embodiments of the invention by way of example. In the drawings:-

Figure 1:
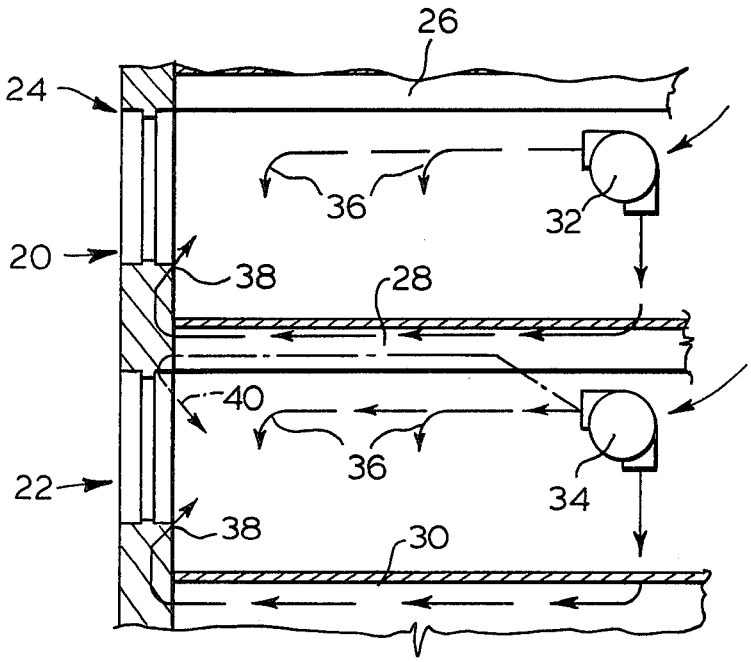
FIG. 1 is a diagrammatic illustration of part of an air circulation system in a multi-storey building.

Reference will first be made to FIG. 1, which shows two stories, 20 and 22 of an air conditioned multi-storey building. Numeral 24 denotes part of an outside wall and numerals 26, 28 and 30 denote the floor/ceiling structures between vertically adjacent stories of the building. Wall 24 is made up of suspended curtain walls.

Each storey of the building has a fan unit for delivering air to that storey. The fan units are located in special fan rooms or closets usually in the centre area of the building, although the air could be delivered from a central fan unit in an alternative embodiment. In FIG. 1, two typical such units are indicated at 32 and 34. Treated (heated or cooled fresh air from outside the building is delivered to the fan units. Each unit delivers this air to the occupied space on the storey in question and also serves to recirculate air. In a typical conventional installation, each fan unit delivers air both to overhead air outlets and to outlets located adjacent the sill of the outside window of the storey in question. In FIG. 1, numeral 36 indicates overhead outlets and numeral 38 indicates window sill outlets. Outlets 38 are supplied with air through ducts located between the floor of the storey in which they are installed, and the ceiling of the storey below.

In an alternative system, the sill outlets may be replaced by outlets disposed adjacent upper edges of the windows. These outlets produce downwardly directed air streams adjacent the windows as indicated in chain lines at 40.

Figure 2:
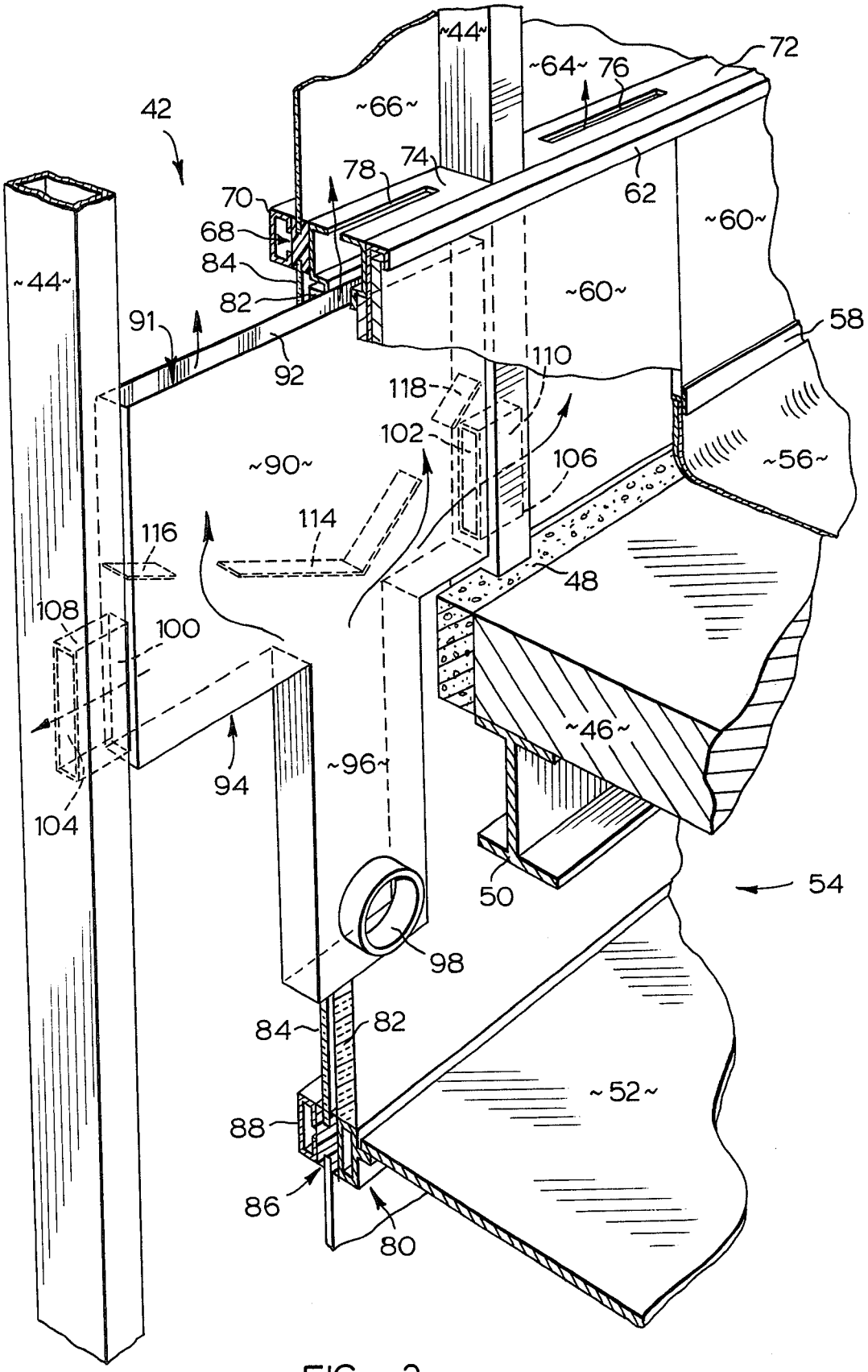
FIG. 2 is a view from the inside of one of the so-called "curtain walls" used in such a building, and is partly broken away to show internal structure; and, FIG. 3 is a view similar to part of FIG. 2 and illustrates an alternative embodiment of the invention.

FIG. 2 shows part of one of the curtain walls of the building at the position of one of the floors of the building of FIG. 1. In FIG. 2, the curtain wall is generally denoted 42 and includes vertical posts or mullions 44 arranged in parallel spaced positions. The mullions define a plurality of adjacent wall sections, two which are visible in the drawing. Part of a floor between the stories is shown at 46 and is separated from the curtain wall 42 by a concrete or other fire proof infill 48. The floor is supported by I-beams, one of which is visible at 50. Part of the ceiling of the storey below is visible at 52 and defines with the floor 46 a crawl space denoted 54. Floor 46 is provided with a covering 56 which is turned upwardly adjacent the curtain wall 42 to define a rounded corner between the floor and the wall inside the building. The floor covering terminates in a molding 58 which also serves to retain the lower edge of a wall panel 60. A second molding 62 retains the upper edge of panel 60.

The curtain wall 42 includes windows between the mullions 44. In FIG. 2, two adjacent window panes are visible at 64 and 66. The lower edges of the panes 64 and 66 are each received in a slotted retaining member 68 which is covered by a facing strip 70 at the exterior of the curtain wall. Although a single window pane only is shown in FIG. 2, it is of course to be understood that a double glazed window panel could be used instead with a suitable form of retaining member. In any event, transverse members 72, 74 extend between the mullions 44 at the inner sides of the respective window panes 64, 66 and define window sills. The wall panel-retaining molding 62 is attached to the inner faces of the sill members. Each sill member is generally of inverted channel shape and is provided in its base (i.e., in the upper surface of the sill) with an air outlet slot through which conditioned air issues upwardly at the inner surface of the relevant window pane (see later). In FIG. 2, the slots in the sill members 72 and 74 are denoted respectively 76 and 78.

Located below and parallel to each sill member at the level of the ceiling 52 is a further transverse member 80 which extends between the mullions 44. This member is of box section and supports the ceiling 52. A wall panel or spandrel 82 of an insulating material extends between member 80 and sill member 74 to in effect close off the exterior of the crawl space 54. In addition, a glass panel 84 is provided on the outside of spandrel 82. The upper edge of this panel is received in the retaining member 68 for the window panel 66 and the lower edge of this panel is received in a similar retaining member 86 attached to member 80. A facing strip 88 is attached to the outside of the retaining member 86. It will of course be appreciated that although retaining members have been shown for the upper and lower edges only of the window panes 64 and 66 and of panel 84, similar members will be provided for retaining the side edges of these parts.

Located between the mullions 44 which are visible in FIG. is an air outlet unit 90 which defines an air chamber 91. The unit is located between the spandrel 82 and the inner wall panel 60 of the curtain wall and has an open upper end 92, which defines a first air outlet throught which chamber 91 communicates with the slot 78 in the sill member 74. Unit 90 includes a main rectangular section 94 dimensioned to fit between the mullions 44 and which extends from the level of floor 46 to a position just below the sill member 74. Unit 90 also includes a relatively narrow section 96 which depends from the main section 94 to a position between the floor 46 and the ceiling 52. A tubular air inlet member 98 is fitted to and communicates with the interior of section 96. An air supply duct (not shown) is connected to inlet 98 and is supplied with air from the fan unit of the relevant storey of the building (see FIG. 1). The duct extends through the crawl space between the floor 46 and the ceiling 52.

The air outlet unit 90 is of hollow sheet metal construction and is closed at all its edges except for the top edge 92 referred to above. In addition, rectangular outlets 100 and 102 are provided in the side edges of the rectangular section 94 of the unit. These second and third outlets of the unit communicate with correspondingly shaped lateral openings 104, 106 formed in the mullions. Openings 104 and 106 have rectangular-section liners 108, 110 which, in effect, act as extensions of the unit 90 to convey air through the mullions and into the air spaces of adjacent wall sections. Air deflectors 114, 116 and 118 are provided inside the unit 90 to route some of the incoming air through the outlets 100 and 102. It will be noted that the central deflector 114 is generally V-shaped and serves to deflect incoming air to both sides of the unit. The deflectors 116 and 118 are spaced from respectively opposite sides of deflector 114 so that some air can escape between the spaces and out through the upper edge 92 of the unit. Unit 90 accordingly supplies air to three adjacent sections of the curtain wall. In other words, only one air outlet unit is required for every three sections of any given curtain wall. Alternatively, outlet units could be provided in every alternate section. In this event, the intervening sections may receive air from each of two adjacent air outlet units or each unit may serve only two wall sections. In the latter event, the unit would of course require only one lateral outlet (100 or 102).

Figure 3:
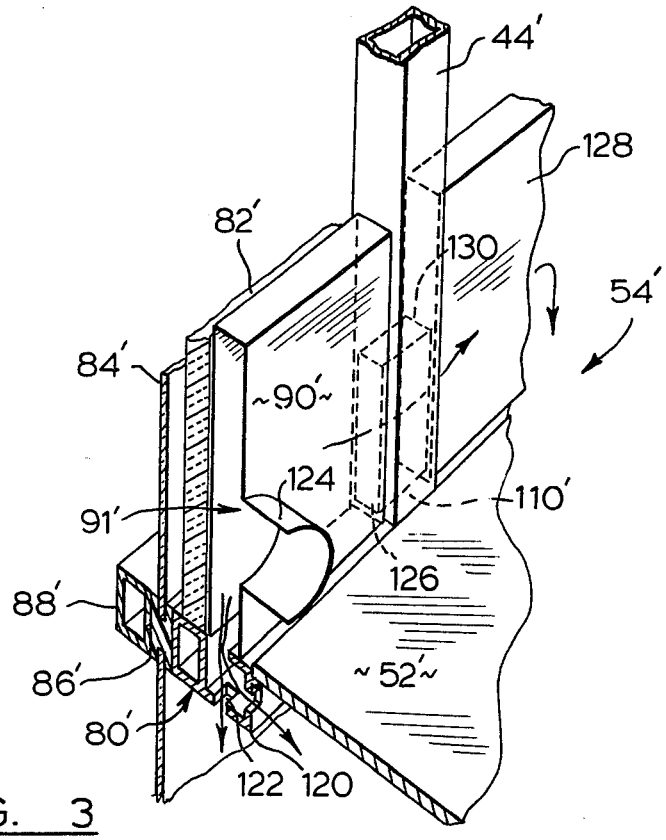

FIG. 3 shows an alternative embodiment of the invention for use in an arrangement in which air is delivered downwardly from adjacent the upper edge of a window in a curtain wall (see numeral 40 in FIG. 1). FIG. 3 shows the bottom portion of the crawl space in a building having a curtain wall similar to that described in connection with FIG. 2. For convenience, primed reference numerals have been used in FIG. 3 to denote parts which correspond with FIG. 2.

In the arrangement of FIG. 3, the ceiling support member 80' has an angle section extension 120 at the inner side of the curtain wall. The ceiling 52' is supported by a flange on this extension. Extension 120 is formed with apertures 122 which open into the occupied space of the storey below the ceiling 52', into which conditioned air is to be delivered. In this case, the curtain wall is fitted with an air outlet unit 90' which is of simple rectangular shape and which, at its lower end, rests on an inwardly directed flange on the extension 120 of member 80'. As in the previous embodiment, unit 90' is of sheet metal construction. A tubular air inlet member 124 is provided at one side of the air chamber for connection to an air supply duct. The air chamber has an open lower end which forms an outlet through which air is delivered into the occupied space below ceiling 52'. In addition, chamber 90' has rectangular outlets in its side edges, one of which is visible to FIG. 3 at 126. As in the previous embodiment, these outlets communicate with openings in the adjacent mullions 44' whereby conditioned air can be delivered into the air spaces in adjacent sections of the curtain wall. Each of these spaces receives a box 128 which is similar to the air chamber 90' but without the inlet member 124. Also, each box 128 has only one lateral opening 130. These boxes serve to constrain incoming conditioned air for delivery in the downward direction into the space below the ceiling 52'.

It will be appreciated that the invention provides economies in terms of constructional costs since only one in every two or three sections of a wall need be serviced by air ducts, compared with conventional systems which require an outlet for each section. Also, it is believed that the structure of the invention provides advantages in terms of reduced fire risk.

It will also be appreciated that although a number of specific embodiments of the invention have been described above, many modifications are possible within the broad scope of the invention. For example, the invention has been described in relation to a specific type of curtain wall structure. However, the invention may of course be used in other types of curtain wall or indeed in any other suitable wall structures.

What I claim is:

1. A wall structure incorporating at least one air outlet unit for a forced air circulation system;

wherein the structure includes: a plurality of spaced vertical posts defining at least two adjacent wall sections, each including: a transverse member extending between the posts defining said section; and inner and outer wall panels co-operating with said member to define an air space between the posts; said transverse member being formed with at least one opening through which air can flow from said air space;

and wherein the air outlet unit is disposed in the said air space of one of said at least two adjacent sections and defines a chamber having: an air inlet adapted to be coupled to an air supply duct of said air circulation system; a first air outlet communicating with said opening of the transverse member defining the air space; and at least one additional air outlet for delivering air to the air space of said adjacent wall section, the intervening wall post being formed with an opening permitting communication between the last-mentioned air space and said additional air outlet, so that air delivered to the outlet unit in use issues through the outlet openings in the transverse members of both of said adjacent wall sections;

and wherein the transverse member of at least one of said wall sections defines a window sill, the inner and outer wall panels of that section being disposed below the sill member;

and wherein the structure further includes a window panel above said sill member, said opening in the sill member being disposed at the inner side of the window panel, whereby air issuing through said opening in the sill member passes upwardly at the inner side of the window panel.

2. A wall structure as claimed in claim 1, in a building having at least two stories separated by a floor and a ceiling spaced from one another to define a crawl space, wherein the air outlet unit is of a boxform construction and includes a main rectangular section dimensioned to fit between said posts defining the wall section which receives the unit, and a narrow section which depends from said main section and which includes said air inlet of the unit, the unit being positioned such that the air inlet is located in said crawl space, and wherein the air outlet unit includes two additional air outlets located at respectively opposite sides of the main section of the unit and co-operating with openings in relevant one of said posts, whereby said unit communicates with air spaces in two adjacent wall sections, and wherein the air outlet unit further includes deflector means disposed within said main section and arranged to deflect into said additional air outlets part of the air flowing through the unit when the unit is in use.

3. A wall structure as claimed in claim 1, in a building having at least two stories separated by a floor and a ceiling spaced from one another to define a crawl space, wherein said transverse member of each wall section is positioned at the level of the said ceiling, with said opening in the member in communication with the space below the ceiling, and wherein said air outlet unit is of rectangular box form and is located immediately above said transverse member with its said air inlet located in said crawl space and said first air outlet in communication with the opening in said transverse member, and wherein the unit includes two additional air outlets located at respectively opposite sides of the unit for and co-operating with openings in relevant ones of said posts, whereby the unit communicates with the air spaces in two adjacent sections, and wherein each said adjacent wall section is fitted with a box form member to constrain the air flow from said air outlet unit, each of said box form members having an air outlet adjacent its lower end for communication with the openings in the transverse members of those sections.

* * * * *